US007828467B2

(12) United States Patent
Lee

(10) Patent No.: US 7,828,467 B2
(45) Date of Patent: Nov. 9, 2010

(54) STREET LIGHT SOURCE ASSEMBLY WITH SOLID STATE LIGHT EMITTING ELEMENTS

(75) Inventor: Han-Lung Lee, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 194 days.

(21) Appl. No.: 12/202,591

(22) Filed: Sep. 2, 2008

(65) Prior Publication Data

US 2009/0231845 A1 Sep. 17, 2009

(30) Foreign Application Priority Data

Mar. 14, 2008 (CN) ..... 2008 1 0300585

(51) Int. Cl.
*F21V 5/00* (2006.01)
*F21S 8/00* (2006.01)

(52) U.S. Cl. ..... 362/331; 362/268; 362/244; 362/237

(58) Field of Classification Search ..... 362/237, 362/230, 231, 235, 236, 240, 244, 246, 268, 362/311.02, 331, 334, 335, 800
See application file for complete search history.

(56) References Cited

U.S. PATENT DOCUMENTS 2,662,165 A * 12/1953 Franck ..... 362/227
6,942,361 B1 * 9/2005 Kishimura et al. ..... 362/240
7,172,319 B2 * 2/2007 Holder et al. ..... 362/341

* cited by examiner

*Primary Examiner*—Bao Q Truong
(74) *Attorney, Agent, or Firm*—Andrew C. Cheng

(57) ABSTRACT

A street light source assembly includes a number of spaced solid state light emitting elements for emitting light beams, a number of first light diverging members, and a number of second light diverging members. Each of the first diverging members comprises a first concave light incident surface facing the respective one of the solid state light emitting elements. Each of the second diverging members comprises a second concave light incident surface facing the respective one of the first light diverging members. A radius of curvature of each the second concave light incident surface is larger than that of the corresponding first concave light incident surface. The second light diverging members are aligned with the respective first light diverging members and the respective solid state light emitting elements.

7 Claims, 2 Drawing Sheets

STREET LIGHT SOURCE ASSEMBLY WITH SOLID STATE LIGHT EMITTING ELEMENTS

BACKGROUND

1. Technical Field

The present invention relates to light source assemblies, and particularly, to a street light source assembly with solid state light emitting elements.

2. Description of Related Art

Solid state light emitting elements, such as light emitting diodes (LEDs) are widely used in lighting.

Light emitted by an LED will usually illuminate an area between 60 and 90 angle degrees in view of the light, and in any case no more than 120 degrees. In street lighting, this angle coverage may be not satisfactory. In addition, different positions in the illumination may present different light intensities, for example, a light intensity at the edge of illumination may be much less than in the center.

What is needed, therefore, is a street light source assembly with solid state light emitting elements, which overcomes the above problems.

SUMMARY

A street light source assembly includes a number of spaced solid state light emitting elements for emitting light beams, a number of first light diverging members, and a number of second light diverging members. Each of the first diverging members includes a first concave light incident surface facing the respective one of the solid state light emitting elements. Each of the second diverging members includes a second concave light incident surface facing the respective one of the first light diverging members. A radius of curvature of each the second concave light incident surface is larger than that of the corresponding first concave light incident surface. The second light diverging members are aligned with the respective first light diverging members and the respective solid state light emitting elements.

Other advantages and novel features of the present street light source assembly will become more apparent from the following detailed description of embodiment when taken in conjunction with the accompanying drawings.

BRIEF DESCRIPTION OF THE DRAWINGS

Many aspects of the street light source assembly can be better understood with reference to the following drawings. The components in the drawings are not necessarily drawn to scale, the emphasis instead being placed upon clearly illustrating the principles of the present street light source assembly. Moreover, in the drawings, like reference numerals designate corresponding parts throughout the several views.

DETAILED DESCRIPTION OF THE EMBODIMENT

Embodiment of the present street light source assembly will now be described in detail below and with reference to the drawings.

Figure 1:
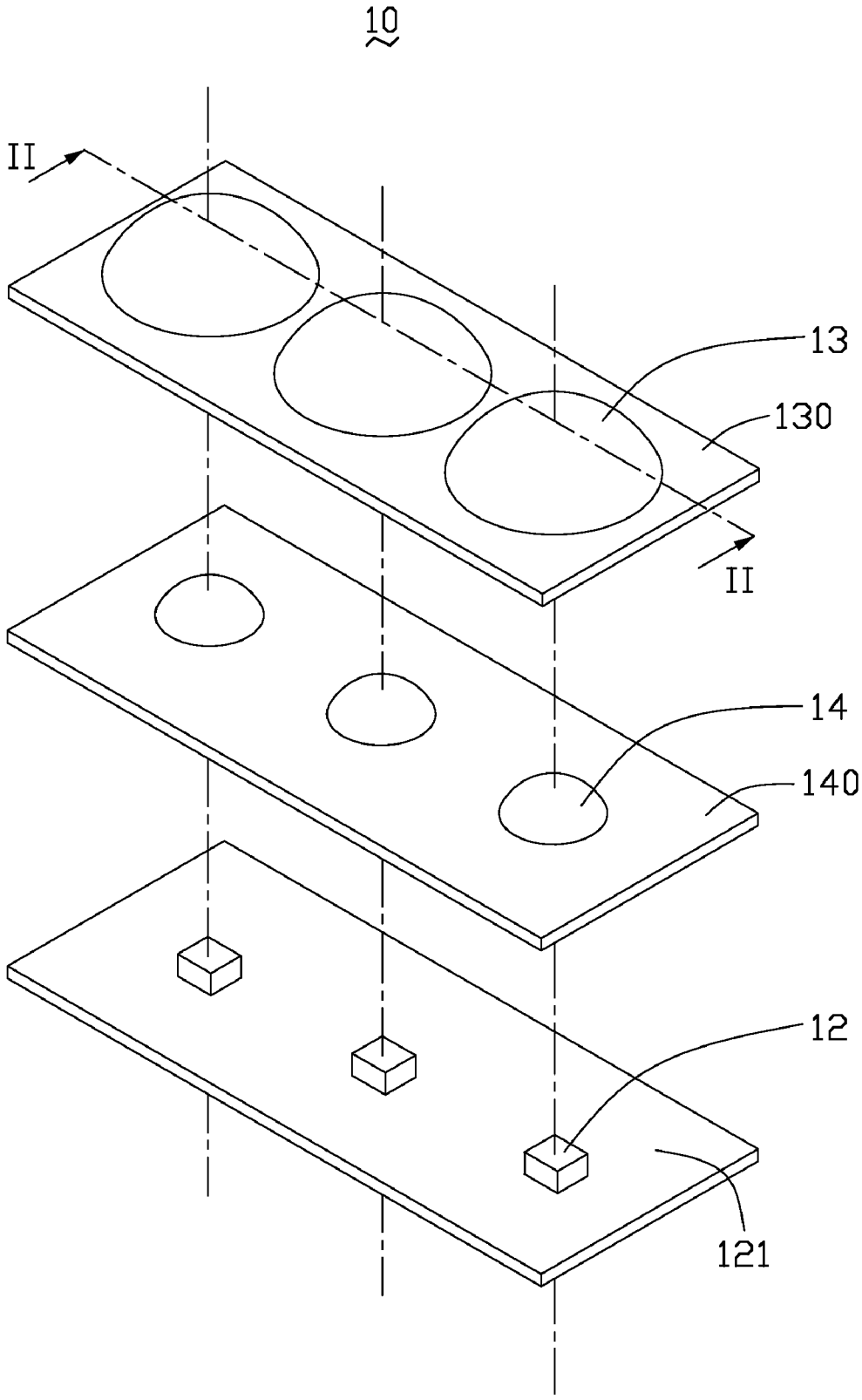
FIG. 1 is a schematic view of a street light source assembly in accordance with an embodiment of present invention.
Figure 2:
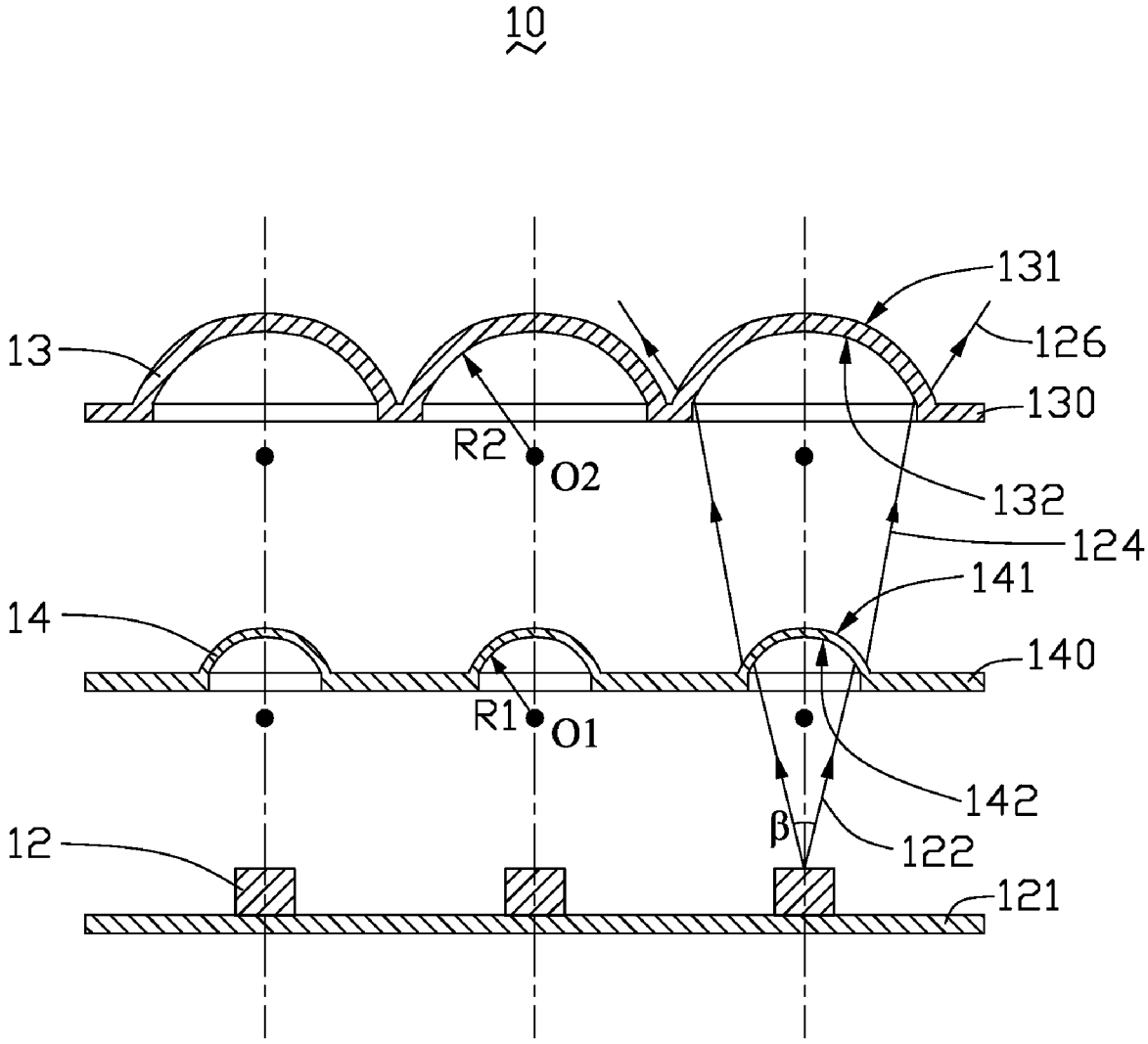
FIG. 2 is a cross-sectional view of the street light source assembly of FIG. 1, taken along a line 11-11.

Referring to FIGS. 1 and 2, a street light source assembly 10 is provided. The street light source assembly 10 includes a number of solid state light emitting elements 12, a number of first light diverging members 14, and a number of second light diverging members 13.

Each of the solid state light emitting elements 12 is an LED, and configured for emitting light beams 122. Angle coverage of the light beams 122 is β. The solid state light emitting elements 12 are spaced apart from each other and are arranged on a same metallic substrate 121. The first light diverging members 14 are spaced apart from each other and are integrally formed with a common base 140. The second light diverging members 13 are integrally formed with a common base 130. The first light diverging members 14 and the second light diverging members 13 can be made from glass by injection molding.

Each of the first light diverging members 14 includes a first concave light incident surface 142 and an opposite first convex light output surface 141. As can be seen in FIG. 2, the first concave light incident surface 142 and the first convex light output surface 141 are concentric about a center point O1. Each of the second light diverging members 13 includes a second concave light incident surface 132 and an opposite second convex light output surface 131. The second concave light incident surface 132 and the second convex light output surface 131 are concentric about a center point O2.

The second light diverging members 13 are center-aligned with the respective first light diverging members 14 and the respective solid state light emitting elements 12. The first concave light incident surface 142 of the respective one of the first light diverging members 14 faces the respective one of the solid state light emitting elements 12. A size of each the first concave light incident surface 142 is sufficient to allow all the light beams from the respective one of the solid state light emitting elements 12 to pass therethrough. The second concave light incident surface 132 of the respective one of the second light diverging members 13 faces the respective one of the first light diverging members 14. A radius R2 of curvature of each the second concave light incident surface 132 is larger than a radius R1 of curvature of the corresponding first concave light incident surface 142.

Refraction occurs when the light beams 122 emitted from the respective solid state light emitting elements 12 transmit through the respective first light diverging members 14, thus first diffused light beams 124 are obtained from each the first convex light output surface 141. Second diffused light beams 126 are obtained from each the second convex light output surface 131 via refraction in the second diverging members 13. The angle coverage of the second diffused light beams 126 is much greater than the angle coverage β of the light beams 122 from the respective one of the solid state light emitting elements 12, and can be qualified for street lighting. Furthermore, due to the refraction, the second diffused light beams 126 are much more uniform in light intensity.

It is understood that the above-described embodiments are intended to illustrate rather than limit the invention. Variations may be made to the embodiments and methods without departing from the spirit of the invention. Accordingly, it is appropriate that the appended claims be construed broadly and in a manner consistent with the scope of the invention.

What is claimed is:

1. A street light source assembly, comprising:

a plurality of spaced solid state light emitting elements for emitting light beams;

a plurality of first light diverging members, wherein the first light diverging members are spaced apart from each other and are integrally formed into a unitary piece with a common plate-shaped base, each of the first diverging members comprising a first concave light incident surface facing the respective one of the solid state light emitting elements and a first convex light output surface opposite to the first concave light incident surface, the first convex light output surface and the first concave light incident surface being concentric about a center point;

a plurality of second light diverging members, wherein the second light diverging members are spaced apart from each other and are integrally formed into a unitary piece with a common plate-shaped base, each of the second diverging members comprising a second concave light incident surface facing the respective one of the first light diverging members, a radius of curvature of each the second concave light incident surface being larger than that of the corresponding first concave light incident surface, the second light diverging members being aligned with the respective first light diverging members and the respective solid state light emitting elements, an angle coverage of diffused light beams emitted out from each of the second light diverging members being greater than an angle coverage of light beams emitted from a corresponding solid state light emitting element.

2. The street light source assembly of claim 1, wherein each of the solid state light emitting elements is a light emitting diode.

3. The street light source assembly of claim 1, further comprising a metallic substrate, the light emitting diodes mounted on the metallic substrate.

4. The street light source assembly of claim 1, wherein the first and second light diverging members are comprised of glass.

5. The street light source assembly of claim 1, wherein a size of each the first concave light incident surface is sufficient to allow all the light beams from the respective one of the solid state light emitting elements to pass therethrough.

6. The street light source assembly of claim 1, wherein each of the second light diverging members further comprises a second convex light output surface opposite to the second concave light incident surface.

7. The street light source assembly of claim 6, wherein the second convex light output surface and the second concave light incident surface are concentric about a center point.

* * * * *